US005895044A

United States Patent [19]

Bahramian

[11] Patent Number: 5,895,044

[45] Date of Patent: Apr. 20, 1999

[54] THREE-DIMENSIONAL PUZZLE WITH MAGNETIC AND MECHANICAL ATTACHMENT, PARTICULARLY FOR USE BY PEOPLE WITH IMPAIRED VISION

[76] Inventor: Mohammad Hossein Bahramian, 1 rue Blaise Desgoffe, 75006 Paris, France

[21] Appl. No.: 08/930,550

[22] PCT Filed: Apr. 24, 1996

[86] PCT No.: PCT/FR96/00625

§ 371 Date: Oct. 3, 1997

§ 102(e) Date: Oct. 3, 1997

[87] PCT Pub. No.: WO96/33785

PCT Pub. Date: Oct. 31, 1996

[30] Foreign Application Priority Data

Apr. 28, 1995 [FR] France ..... 95 05121

[51] Int. Cl.[6] ..... A63F 9/12

[52] U.S. Cl. ..... 273/157 R; 273/156

[58] Field of Search ..... 273/157 R, 156, 273/155, 153 R, 153 S

[56] References Cited

U.S. PATENT DOCUMENTS

| | | | |
|---|---|---|---|
| 2,570,625 | 10/1951 | Zimmerman et al. | 273/157 R |
| 3,523,384 | 8/1970 | Adelsohn | 273/157 R |
| 3,564,735 | 2/1971 | Fisher | 273/157 R |
| 3,596,380 | 8/1971 | Williams . | |
| 3,689,075 | 9/1972 | Adelsohn | 273/157 R |
| 3,779,558 | 12/1973 | Moreau | 273/157 R |
| 4,513,970 | 4/1985 | Opresco et al. | 273/157 R |
| 4,865,324 | 9/1989 | Nesis | 273/155 |
| 5,127,652 | 7/1992 | Unger | 273/157 R |

FOREIGN PATENT DOCUMENTS

| | | |
|---|---|---|
| 0 185 628 | 6/1986 | European Pat. Off. . |
| 2 569 126 | 2/1986 | France . |
| 2 614 210 | 10/1988 | France . |

*Primary Examiner*—Steven Wong
*Attorney, Agent, or Firm*—Young & Thompson

[57] ABSTRACT

A puzzle includes pieces of different and random shapes and/or sizes, which can occupy only one position in the puzzle and which can be assembled by magnetic forces as well as by co-operating positioning projections and hollows, on the surface of the pieces. Each of the projections and recesses has a unique shape and/or size, so that the invention is particularly suitable for educational and cultural applications, more particularly for use by people with impaired vision.

14 Claims, 8 Drawing Sheets

THREE-DIMENSIONAL PUZZLE WITH MAGNETIC AND MECHANICAL ATTACHMENT, PARTICULARLY FOR USE BY PEOPLE WITH IMPAIRED VISION

The present invention relates to a three-dimensional puzzle.

Three-dimensional puzzles are well-known games of patience which may have an educational function, particularly an early learning role in sculpture and artistic sensitization when they reproduce famous or original works of art, such as museum pieces.

Amongst the simplest puzzles, mention may be made of the combination game disclosed by EP-A-0,051,576, which is formed from parallelepipedal elements which each contain at least one permanent magnet so that all the juxtaposed and superimposed elements of the puzzle hold together by means of magnetic attraction forces. The drawback with this type of puzzle is that they lack holding since their component parts are likely to slide over one another. Moreover, the shape of the individual elements of this known puzzle is particularly limited.

Other known three-dimensional puzzles are assembled by mechanical means. For example, French Utility Certificate Application FR-A-2,340,110 discloses a support-free puzzle consisting of complementary three-dimensional elements, occupying a single position in the said puzzle, assembled along arbitrary bearing surfaces to form tongue-and-groove joints or dovetail protuberances and cavities. The fragments may have a thin dish shape so that the resulting puzzle is hollow, or may be in the form of rods, wedges and/or cones. Patent Application EP-A-0,054,577 discloses a three-dimensional puzzle formed by two hemispheres which each consist of a cluster of three-dimensional pieces with a planar surface at the join between the two hemispheres. The pieces of the puzzle are connected together by a pair of spaced, parallel rods which penetrate into bores made in the puzzle. Two other rods perpendicular to the surface where the hemispheres join allow the two hemispheres to be connected together. Other puzzles still, such as that disclosed in U.S. Pat. No. 4,865,324, consist of pieces which are associated both by mechanical and magnetic means. The pieces, of geometrical shape, are precisely magnetized and provided with paired protrusions and cavities arranged symmetrically with respect to the center of the pieces.

The principal drawback with these known puzzles is that they are not adapted to containing pieces which each have a distinct and arbitrary shape and/or dimensions so they are unsuitable for the reproduction of works of art in the form of puzzles.

On the other hand, the invention proposes a three-dimensional puzzle comprising fragments of distinct and arbitrary shapes and/or dimensions which can occupy only a single position within the said puzzle, at least two of the said fragments each comprising at least one magnetic element oriented in such a manner that the said fragments are attracted to one another when they are suitably positioned.

Document FR-A-2,517,979 discloses a three-dimensional puzzle of the above-mentioned type whose various component fragments are kept assembled by magnetization and may or may not be cubic and may be identical or different. However, the puzzle does not hold together sufficiently and does not provide the tactile sensations necessary for application in children's educational or cultural early learning activities or in games for the visually impaired. The same applies to the three-dimensional puzzle disclosed in Patent U.S. Pat. No. 3,779,558, which is formed from pieces which are assembled either by mechanical means or by magnetic means and whose surfaces which are in mutual contact are not entirely paired with one another, the various pieces of this known puzzle not having, furthermore, a totally arbitrary shape and thickness.

The invention makes it possible to solve this double tactile and holding problem in that the surface of each of the fragments of the puzzle according to the invention is provided with at least one positioning protrusion and/or hollow capable of being paired with a positioning hollow and/or protrusion, respectively, provided on an adjacent fragment so that the said fragments are assembled both by mechanical and magnetic means. Moreover, the fragments, which have distinct and arbitrary shapes and/or dimensions, are closely paired with one another along their mutually adjacent surfaces. The holding together of the assembly is then reinforced. The positioning protrusions and hollows also each have a unique shape and/or size, which makes the invention particularly suited to the above-mentioned, applications. It will be understood that one fragment may interact, via one of its faces, with one or more other fragments or with one or more parts of other fragments.

It will also be understood that the particular configuration of the puzzle according to the invention makes it suitable for the reproduction of any three-dimensional shape or sculpture and, in particular, for the reproduction of works of art, such as museum pieces, which offers it remarkable cultural and educational applications which are impossible with known puzzles.

According to one embodiment of the invention, at least one of the said fragments represents an individualized object, such as an artistic, figurative or other plastic shape which may or may not take up the principal theme of the puzzle.

According to a further embodiment of the invention, at least one of the fragments of the puzzle represents an individualized object and the other fragments are arranged around the said object. In this case, variations in the outer surface of the individualized object may constitute a set of positioning protrusions and hollows which interact with positioning hollows and protrusions, respectively, of at least some of the said other fragments. Thus, it is possible, for example, to make provision for the object to have the form of a known sculpture, which may be inserted in another known or original sculpture or in a pyramid, for example, which consist of fragments, at least a part of which has a surface which is paired with a portion of the surface of the said object and forms a first layer around it, and of which, optionally, another part forms one or more layers around this first layer. In this way, the object inserted in the three-dimensional puzzle may, optionally, be an unaltered original which does not contain any magnetic element or elements, and the whole puzzle will hold together, in this case, by means of the fragments arranged around the object, at least two of which enclose at least one magnetic element.

Alternatively, provision may be made for the object to be opaque and for at least some of the other fragments to be translucent. In this case, if it is desired that the magnetic elements should not be visible, only the two fragments forming the vertex and the base of the pyramid will be opaque and will contain one or more magnetic elements holding the assembly together, the other fragments being translucent.

According to a further embodiment still, the puzzle according to the invention, designated as the "global puzzle", may comprise primary and secondary fragments, which secondary fragments:

are adapted to form, once assembled together, independently of the said primary fragments, a three-dimensional puzzle, designated as the "secondary puzzle", representing an individualized object, and are capable of being dispersed and integrated amongst the said primary fragments to form the said global puzzle.

In the above cases when one or more of the fragments of the puzzle, taken in isolation or in combination, represent an individualized object, the other fragments may, optionally, be such that the omission of the said object or of its component fragments does not affect the holding together nor the external configuration of the puzzle. It will thus be possible to break the global puzzle down into a so-called "primary" puzzle having precisely the same external form as the global puzzle, but with one or more internal empty spaces and either an individualized object or a secondary puzzle.

According to a further embodiment of the invention, the reconstituted puzzle is formed from two parts which are substantially symmetrical with respect to a median plane and one of the said fragments constitutes substantially one of the said parts. This particular fragment may therefore be used as a support for the other fragments of the puzzle and as a model for reconstituting the puzzle.

According to a further embodiment of the invention, the puzzle also comprises a support formed from at least one substantially planar continuous surface comprising at least one magnetic element and provided with positioning protrusions and/or hollows which are adapted to interact with at least some of the positioning hollows and/or protrusions, respectively, of the said fragments so that the said fragments form at least one layer on the said surface. The support of the puzzle may be fastened to a wall or on the ground or suspended from the ceiling. Thus, the puzzle may, for example, have the form of a wall sculpture to be reconstituted, and this may, optionally, be formed from several layers of superimposed fragments, each of which may evoke a theme, a school of sculpture, etc. This embodiment of the invention is particularly suited to use as a group game, for use by sighted or visually impaired children and adolescents in play areas or cultural spaces.

The protrusions provided on the various fragments consist of any cylindrical, pyramidal, parallelepipedal, etc. projection, such as a protuberance, a point, etc., and the corresponding hollows may be in the form of a hole, a groove, a notch, a parallelepipedal recess, etc. According to a preferred embodiment, at least one of the said fragments may bear a raised inscription constituting at least a part of the positioning protrusions of the fragment bearing it, and the inscription may consist of any signs or symbols, such as figures or individual letters or letters assembled into words or phrases, in any alphabet and any language, Braille inscriptions, hieroglyphs, idiograms, etc. Thus, provision may be made for two fragments which have to be assembled together to bear corresponding inscriptions so that the puzzle may be reconstituted more easily. For example, provision may be made for fragments intended to be assembled in a given order to bear a figure or a letter such that a logical sequence will be formed as the said fragments are assembled. It will thus be understood that, if the said letter belongs to the Braille alphabet, the puzzle according to the invention may be used as an educational tool to assist visually impaired children in learning the Braille alphabet by making provision, for example, for the sequence of letters obtained once the puzzle has been completed to constitute a word identifying the object produced. As a variant, the inscriptions may also indicate the date of the work, its origin, its title, the name of its author, etc. or constitute a text which retraces the history of the object.

The materials which constitute the various fragments of the puzzle may be any material capable of being cut, modelled, engraved, moulded, cast, formed, etc., for example plaster, resin, etc. These materials may be worked either manually or industrially to manufacture the fragments of the puzzle according to the invention. Generally speaking, the prototype will be produced manually, for example from plaster, and the fragments obtained will then be moulded with a view to reproducing them on an industrial scale.

The magnetic element consists of at least one of the following elements: a permanent magnet, a magnetic material, a mixture of magnetic materials, a mixture of one or more magnetic materials with one or more non-magnetic materials, etc. The mixtures may be formed by heating, sintering or melting materials in powder or granular form. They may then be shaped using conventional industrial processes. The various fragments of a single puzzle may consist of the same magnetic elements, different magnetic elements or some may be non-magnetic, but which are kept in place by the surrounding magnetic elements.

Of course, it will be necessary to ensure that the various magnetic elements are suitably arranged with respect to one another so that the resulting magnetic field guarantees that the whole puzzle holds together. To this end, it is possible to contemplate manufacturing the various pieces of the puzzle in the form of non-magnetized magnetic elements, some of the pieces, however, being optionally non-magnetic, then subjecting the reconstituted puzzle to an intense magnetic field which confers similar properties to those of a permanent magnet on the magnetic elements.

The invention will be better understood in the light of the following description, taken in combination with the appended drawings, in which.

Figure 4:
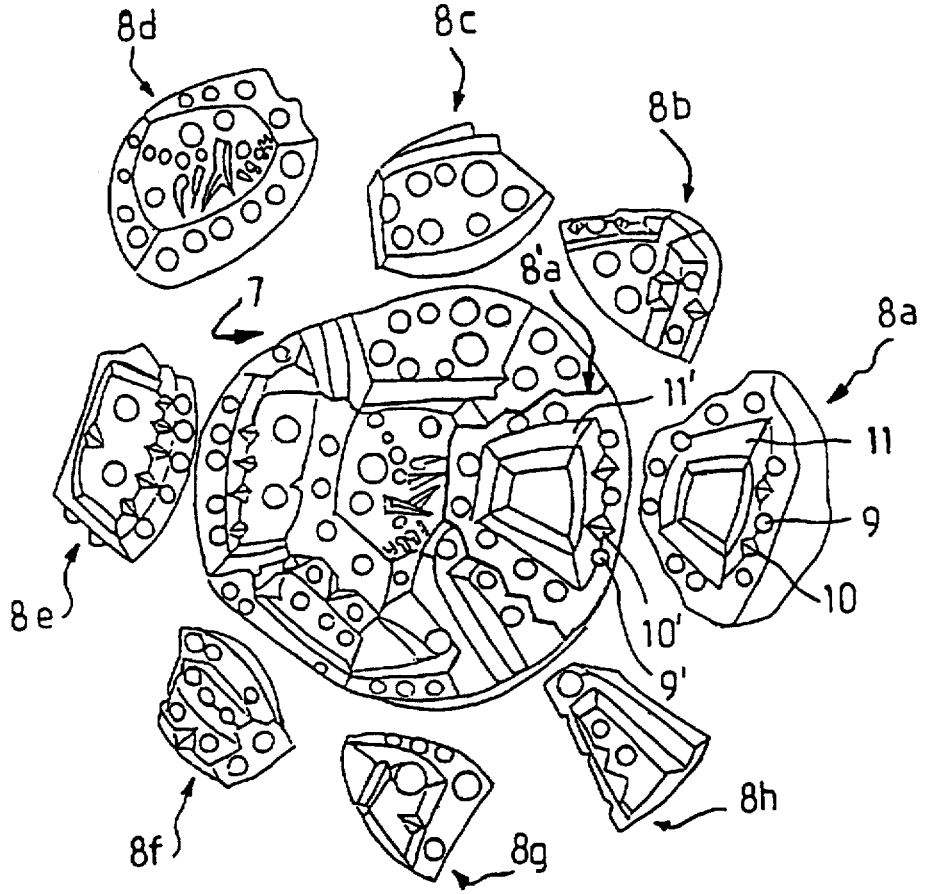
FIG. 4 is a top view of the puzzle in FIG. 1 in the partially reconstituted state.
Figure 4A:
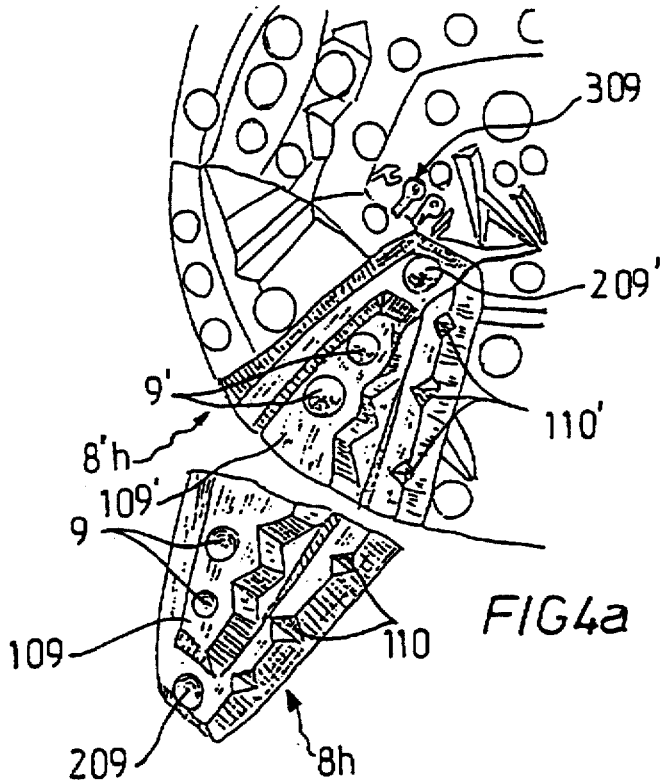
Figure 5:
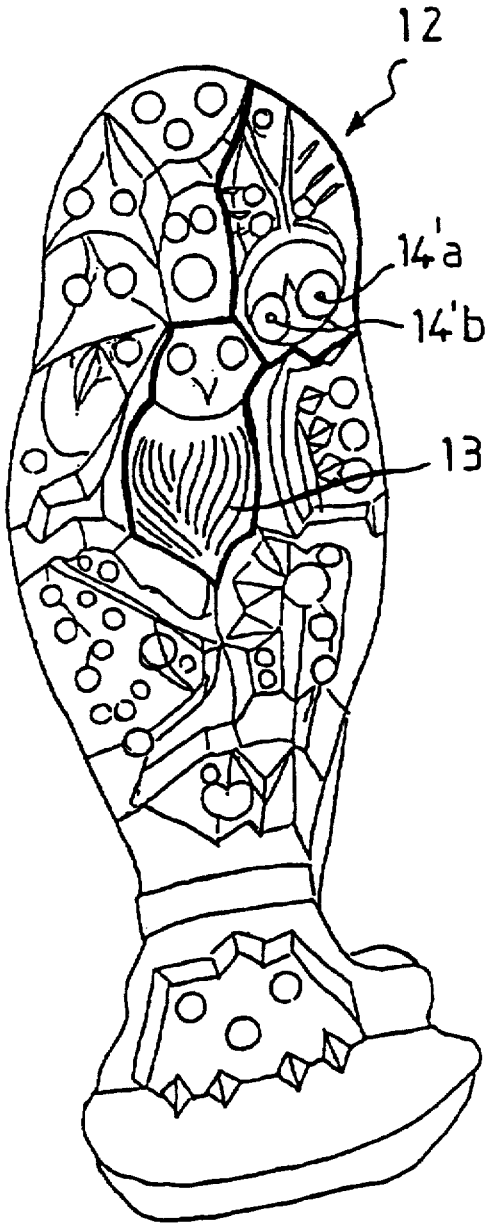
Figure 6:
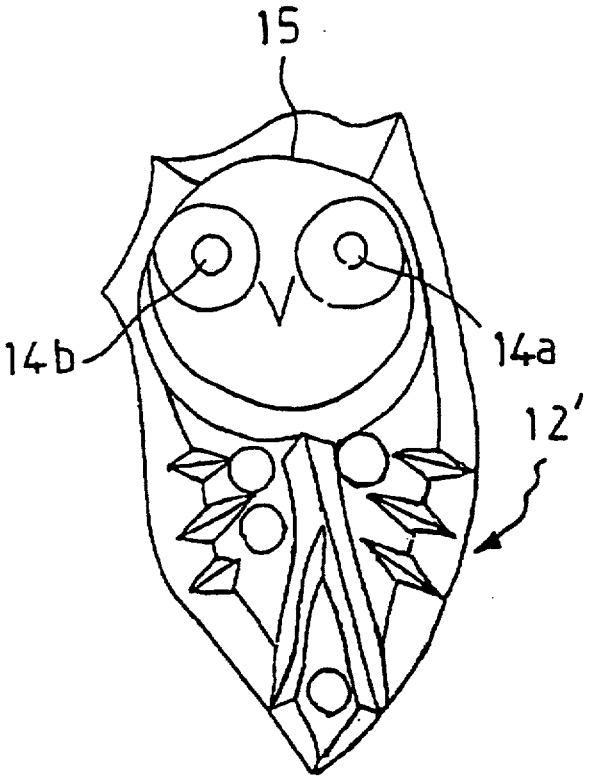
Figure 7A:
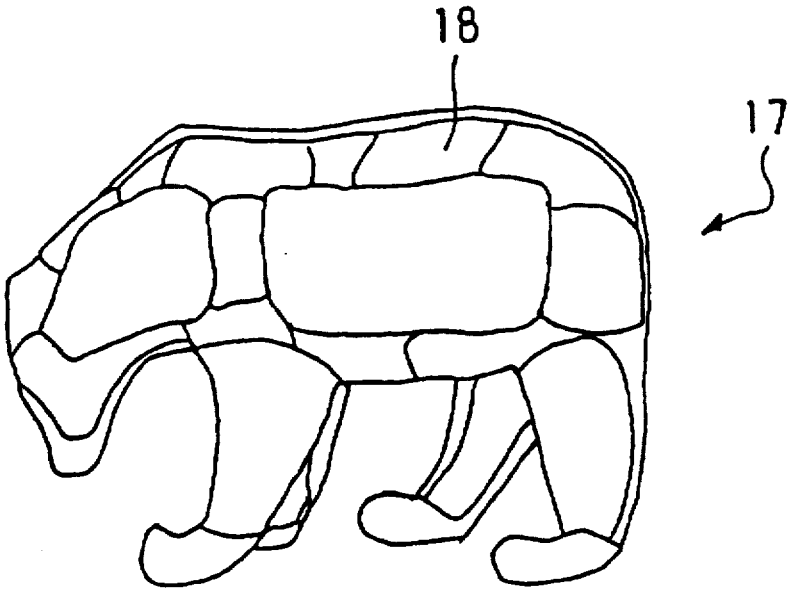
Figure 7B:
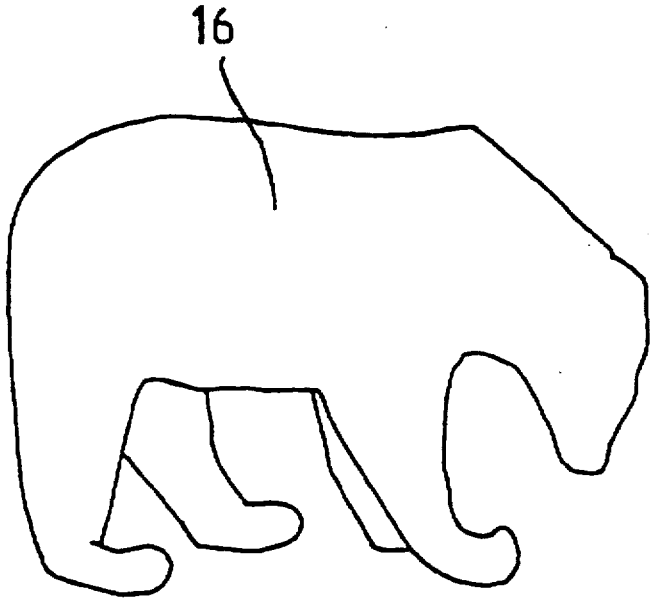
Figure 8:
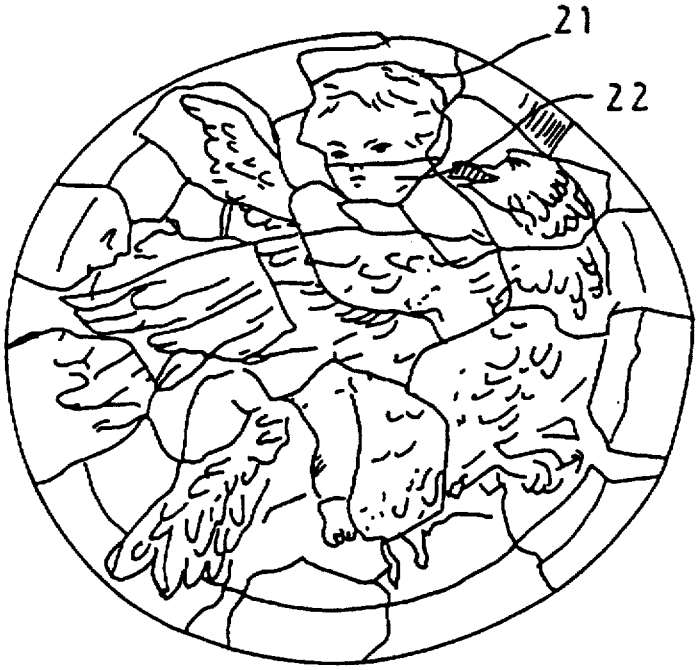
Figure 8A:
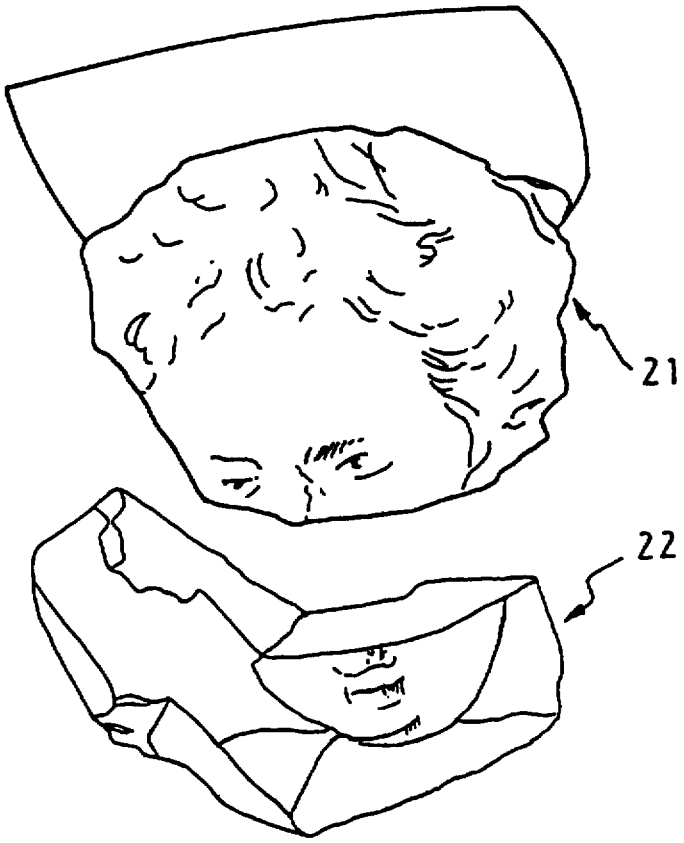
Figure 9:
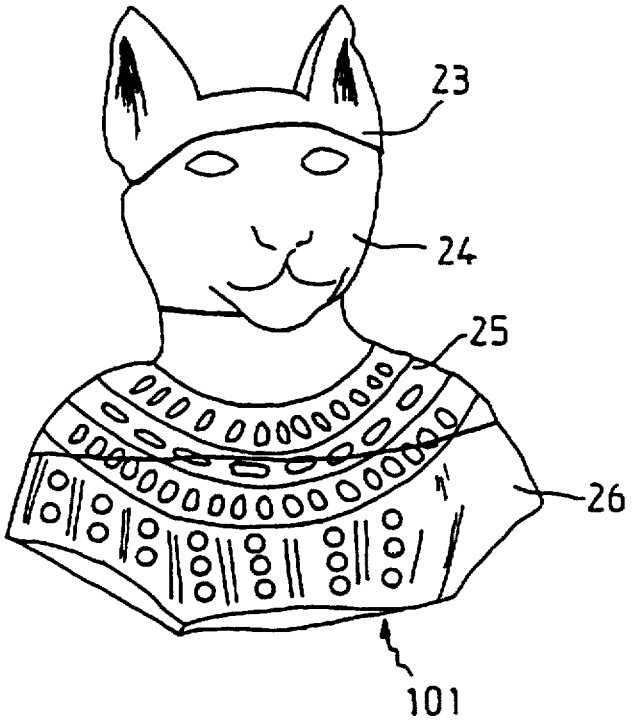
Figure 9A:
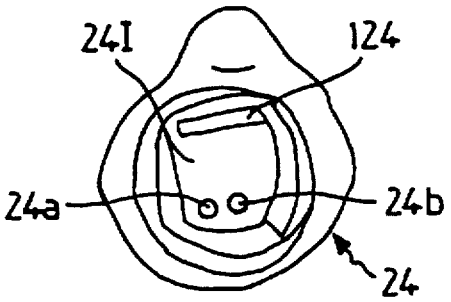
Figure 9B:
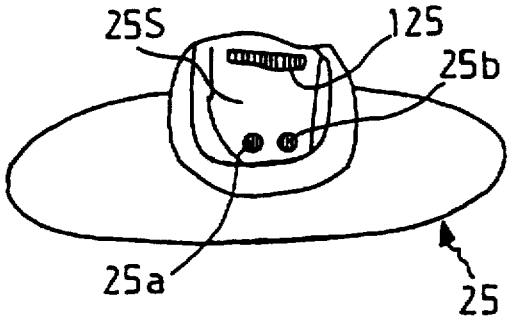
Figure 10:
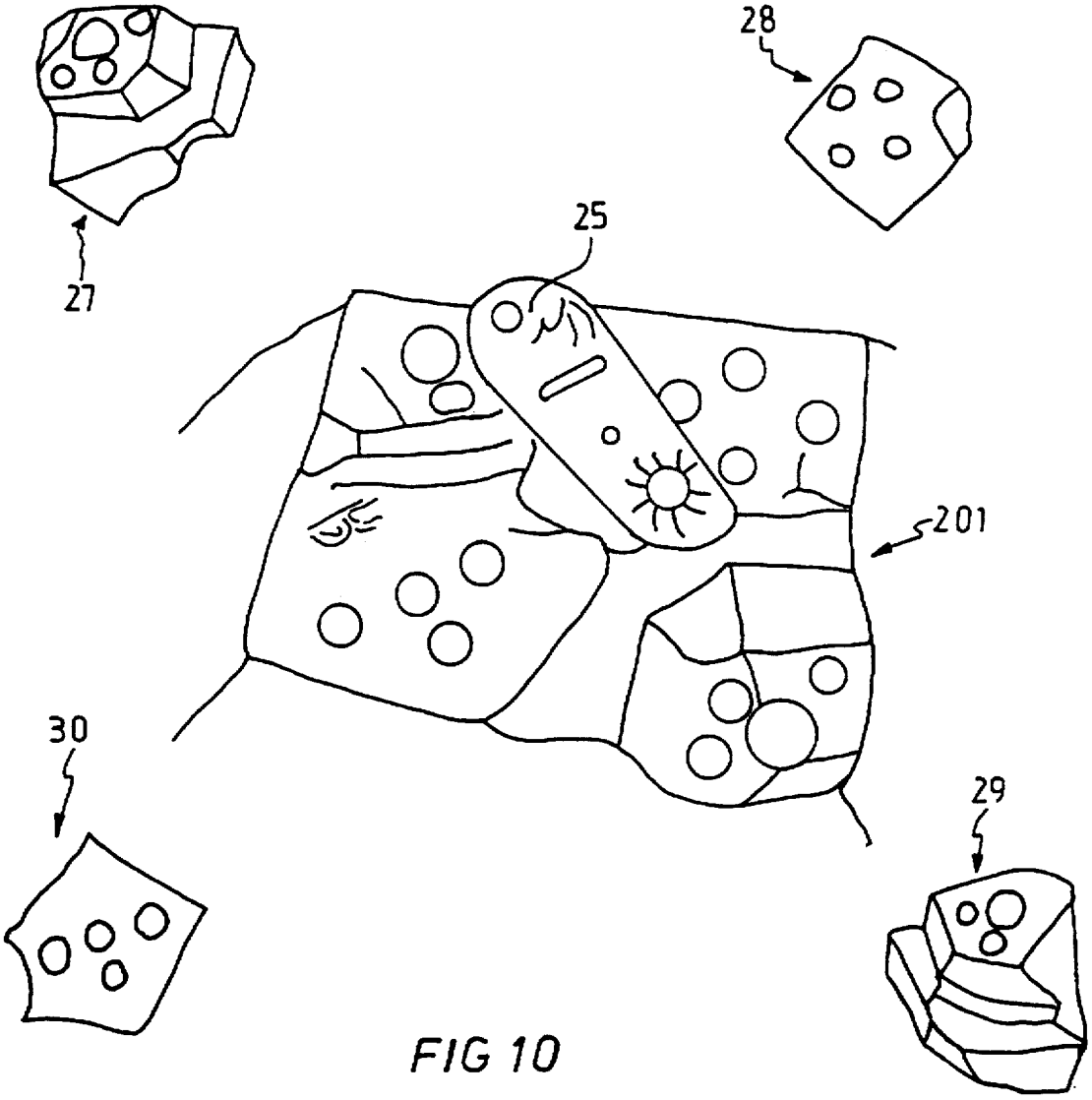
Figure 11:
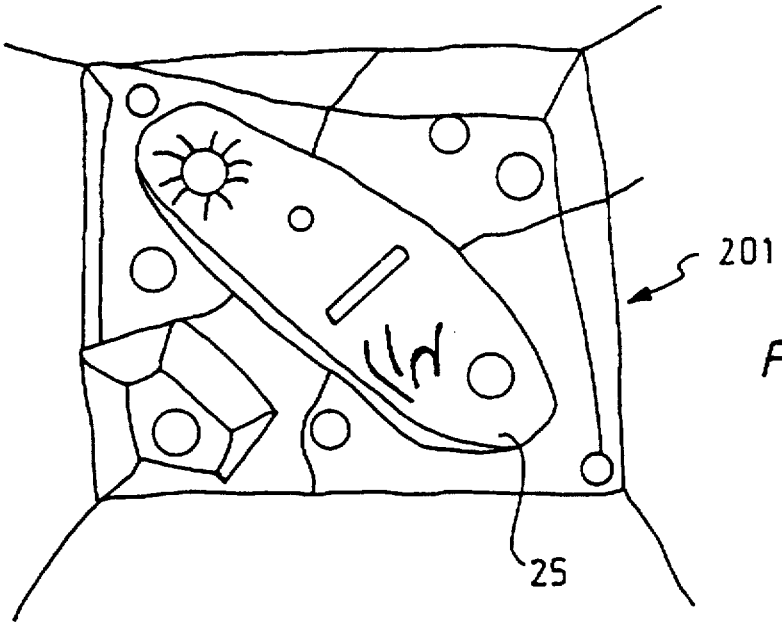
Figure 12:
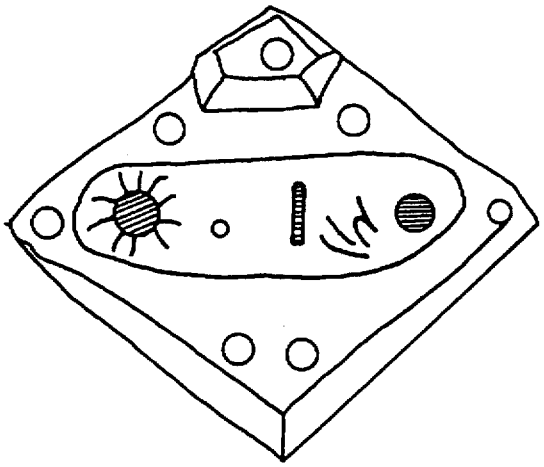
Figure 13:
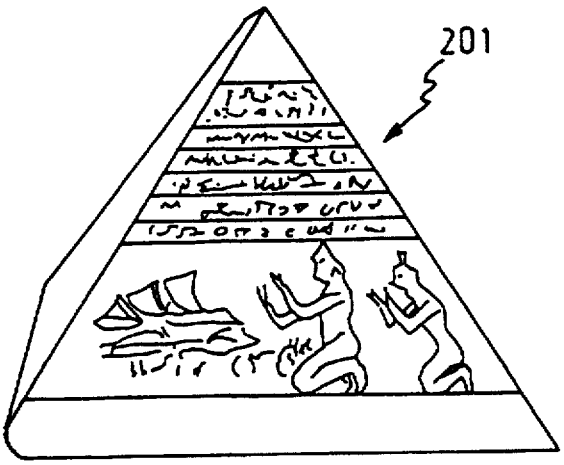

FIG. 4*a* is a view, on a larger scale, of details of FIG. 4, observed from another angle;

FIG. 5 is the front view of a puzzle according to a second embodiment of the invention, in the partially reconstituted state, which—in the totally reconstituted state—will represent an owl;

FIG. 6 is a greatly enlarged front view of a piece of the puzzle complementing the assembly illustrated in FIG. 5;

FIGS. 7*a* and 7*b* are two opposite side views of a puzzle according to a third embodiment of the invention, which represents a bear;

FIG. 8 is a front view of a puzzle according to a fourth embodiment of the invention, in the totally reconstituted state;

FIG. 8*a* is a greatly enlarged perspective view of two pieces of the puzzle illustrated in FIG. 8;

FIG. 9 is a perspective view of a puzzle according to a fifth embodiment of the invention, in the totally reconstituted state;

FIG. 9*a* is a bottom elevation view of a first fragment of the puzzle illustrated in FIG. 9;

FIG. 9*b* is a perspective view of a second fragment of the puzzle illustrated in FIG. 9;

FIG. 10 is a top elevation view of a puzzle according to a sixth embodiment of the invention, in the partially completed state, incorporating the piece illustrated in FIG. 9*b*;

FIG. 11 is a top elevation view of the puzzle illustrated in FIG. 10, at a later stage of construction;

FIG. 12 is a bottom elevation view of a piece of the puzzle complementing the assembly illustrated in FIG. 11; and FIG. 13 illustrates, in perspective, the puzzle in FIG. 10 in the entirely reconstituted state.

Figure 1:
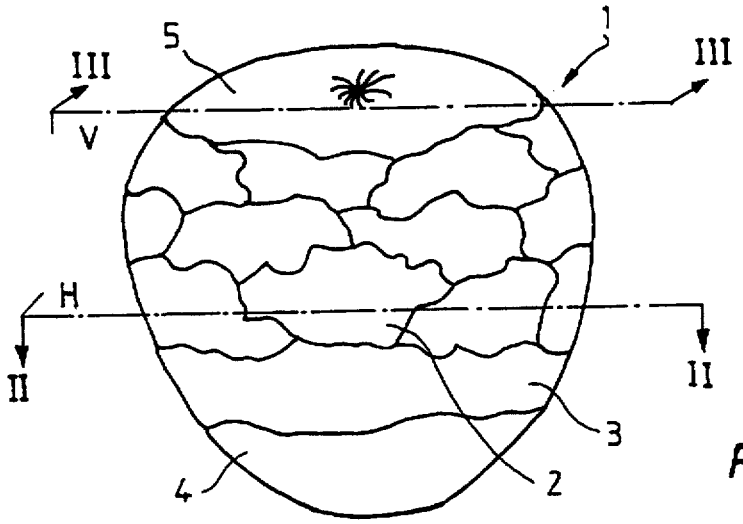
FIG. 1 is a diagrammatic perspective view of a puzzle according to a first embodiment of the invention, in the reconstituted state, which represents an apple.

If reference is made first of all to FIG. 1, which is an example of a self-supported three-dimensional puzzle according to a first embodiment of the invention, it will be possible to see a reconstituted puzzle which represents an apple. The apple 1 consists of forty-two three-dimensional fragments, only some of which are visible in FIG. 1, such as 2, 3, 4, 5 which each have different dimensions and shapes, so that each fragment is unique and occupies a single position within the puzzle 1. It will be noted that the fragments 3, 4 and 5 each substantially represent a slice of the apple cut horizontally in it.

Figure 2:
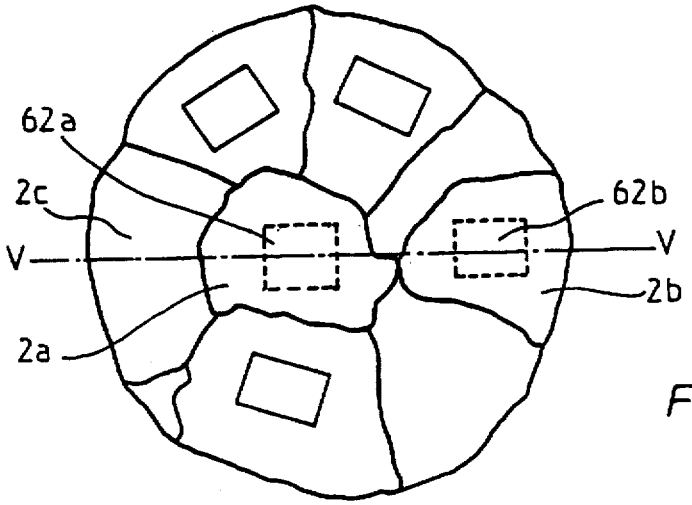
FIG. 2 is a sectional view of the puzzle illustrated in FIG. 1, taken according to the horizontal plane H and observed in the direction of the arrows II—II.
Figure 3:
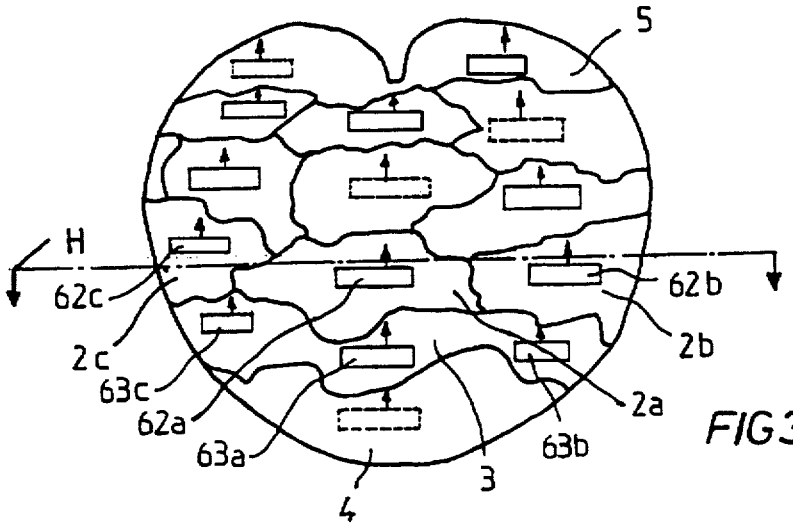
FIG. 3 is a sectional view of the puzzle illustrated in FIG. 1, taken according to the vertical plane V and observed in the direction of the arrows III—III.

FIGS. 2 and 3 are horizontal and vertical sectional views, respectively, which show better the irregular contours of the various fragments in the three dimensions. In these figures, each fragment, such as 2*a–c*, 3, etc., contains at least one magnet of rectangular shape, such as 62*a–c*, 63*a–c*, etc. which are oriented in such a manner that, as indicated by the arrows in FIG. 3, their polarities are inverted. The magnets 63*c*, 63*a* and 63*b* of fragment 3, for example, are therefore attracted by the magnets 62*c*, 62*a* and 62*b* of fragments 2*c*, 2*a* and 2*b* and vice versa, which helps to join the said fragments together.

FIG. 4 illustrates the structure of the various fragments of the apple shown in the preceding figures more precisely. In this figure, the puzzle in FIGS. 1 to 3 is represented in the partially reconstituted state; it is formed from an incomplete apple 7 surrounded by eight fragments 8*a–h* to be placed on it. Each of the fragments 8*a–h* is provided with hollows and/or protrusions. Thus, the fragment 8*a* is provided with ten substantially hemispherical hollows such as 9, with two substantially pyramidal projections, such as 10, and with a recess 11 with a trapezium-shaped section. These protrusions are adapted to interact with ten hemispherical projections, such as 9', two pyramidal notches, such as 10', and a projecting part 11', respectively, of another fragment 8'*a* of the incomplete apple, which will be adjacent to the fragment 8*a* once the puzzle is entirely reconstituted. The fragment 8'*a* is, for greater clarity, delimited by a thicker line in FIG. 4. The enlarged detail in FIG. 4*a* shows the fragment 8*h* which is intended to interact with the fragment 8'*h*. On the fragment 8*h* are substantially hemispherical hollows 9 projecting over the surface of a platform 109 whose edge is notched, a substantially hemispherical projection 209 and substantially pyramidal hollows 110. These shapes interact with paired shapes 9', 109', 209', 110' provided in the fragment 8'*h*, respectively. It will be noted that a date indication appears on one of the fragments at 309.

It is clearly apparent from FIGS. 4 and 4*a* that the interaction of the positioning hollows and protrusions described guarantees not only that the various fragments will be correctly arranged with respect to one another but also that they will be effectively held in position. The number and/or the size and/or the shape and/or the arrangement of the positioning protrusions and/or hollows vary from one fragment to the next.

FIG. 5 illustrates another puzzle according to the invention which, in the totally reconstituted state, represents an owl in twenty-eight fragments. In this figure, the puzzle is partially reconstituted and the various fragments have the same characteristics as those in FIGS. 1 to 4. However, in the variant illustrated, some of the fragments have the particular shape of a highly individualized object. This is the case of the fragment 12', illustrated in FIG. 6, which represents a stylized owl head whose eyes are formed by substantially hemispherical hollows 14*a* and 14*b* and whose contour is delimited by a circular recess 15. These hollows 14*a*, 14*b* are adapted to interact with paired protrusions 14'*a*, 14'*b* provided on the fragment 12 in FIG. 5. The fragment 13 in FIG. 5 also offers a surface on which the design of an owl has been hollowed out and it is adapted to interact with a fragment whose surface represents the same owl in paired protrusion (not shown). The fragments 12 and 13 are, for greater clarity, delimited by a thicker line in FIG. 5.

FIGS. 7*a* and 7*b* show a further embodiment of the puzzle according to the invention, which represents, in this case, in the reconstituted state, a bear in twenty-two fragments, only some of which are visible in these figures. In this variant, the reconstituted puzzle is approximately symmetrical with respect to the longitudinal median plane of the animal represented. One of the lateral faces is monobloc, i.e. it is formed from a single fragment 16, whilst the other 17 consists of several three-dimensional fragments, such as 18. The role of the first monobloc face 16 is to act both as a support for the fragments of the three-dimensional puzzle and as a model for reconstituting the other face.

Another type of partially supported puzzle is illustrated in FIGS. 8 and 8*a*. FIG. 8 shows a puzzle according to the invention in which a large fragment (not visible in this figure) acts as a wall support for the other fragments of the puzzle, such as 21 and 22, which are illustrated on a larger scale in FIG. 8*a*, which form a single layer on it. It is well understood, however, that the support fragment could be covered with several successive layers of other fragments.

FIGS. 9 and 9*a–b* illustrate a puzzle according to a further embodiment still of the invention. The reconstituted puzzle 101, shown in FIG. 9, reproduces the bust of an Egyptian goddess. Each of the fragments 23 to 26 of the puzzle 101 has, on at least one of its opposing surfaces, protrusions or hollows comprising a letter of the Braille alphabet and intended to interact with the hollows or the protrusions, respectively, provided on an adjacent fragment. Thus, the fragment 24 illustrated in FIG. 9*a* has, on its lower surface 24I, two circular protrusions 24*a* and 24*b* bearing the letter c in the Braille alphabet, as well as a rectangular protrusion 124 which serves to define the direction in which the Braille sign should be read by underlining it. The protrusions 24*a*, 24*b* and 124 are paired with the hollows 25*a*, 25*b*, and 125, respectively, made in the upper surface 25S of the fragment 25, as may be seen in FIG. 9*b*. It will therefore be understood that the letters appearing on the various fragments 23–26 of the puzzle may serve to facilitate their assembly by a visually impaired person, a logical sequence of letters or a word being, for example, formed as the fragments are assembled together. Moreover, by analogy with the embodiment shown in FIGS. 5 and 6, it will be noted that the fragment 24 may itself be regarded as an individualized object within the puzzle to which it belongs.

FIG. 13 illustrates a large puzzle 201, designated as a "global puzzle", whose external shape is that of a pyramid and which consists of fragments, designated as "primary fragments", amongst which other fragments, designated as "secondary fragments", have been dispersed and incorporated. As emerges from FIGS. 10 to 13, the fragments of the puzzle 101 shown in FIG. 9, which will hereafter be referred to as the "secondary puzzle", constitute the said secondary fragments. FIG. 10 shows the global puzzle 201 in the partially completed state which incorporates, in particular, as a secondary fragment, the fragment 25 illustrated in FIG. 9*b*. Although this is not visible in this figure, the global puzzle 201 also comprises, in layers which have already been formed, as other secondary fragments, the fragments 23, 24 and 26 illustrated in FIG. 9, which are arranged at locations which are spaced from one another. FIG. 11 shows the same global puzzle 201 at a later stage of construction, in which the primary fragments 27 to 30, illustrated in FIG. 10, have been assembled with the partially reconstituted global puzzle 201. Finally, FIG. 12 shows that part of the puzzle which complements the one illustrated in FIG. 11. It is clearly apparent from these figures that the omission of the secondary fragment 25 in the global puzzle 201 affects the external configuration of this puzzle no more than it does its magnetic holding together. This embodiment therefore produces a kind of nested assembly in which the secondary fragments may either be embedded within the global puzzle or be omitted from the latter and joined together to form, on the one hand, the primary puzzle which, in this case, must have the same external shape as the global puzzle, but will have internal empty spaces, and, on the other hand, the said secondary puzzle.

It emerges from the above description that the invention proposes a three-dimensional puzzle reproducing, for example, a known sculpture, formed from distinct fragments of arbitrary configuration which are assembled by magnetic forces and by mechanical means, the latter consisting of a set of protrusions and hollows whose number, size, arrangement and shape may vary, which makes the invention particularly well suited to the production of educational games appealing to the users' sense of touch and thus particularly suited to the visually impaired.

I claim:

1. A three-dimensional puzzle, which upon completion includes plural fragment sites that each has a unique combination of size and shape, the puzzle comprising:

plural fragments which each have a unique combination of shape and size so that each of said fragments is arranged and adapted to occupy only a single one of the fragment sites within the completed puzzle, each of said fragments being closely paired with adjacent ones of said fragments along mutually adjacent surfaces in the completed puzzle;

at least two of said fragments each comprising at least one magnetic element oriented so that said at least two fragments are attracted to each other when positioned in their respective fragment sites within the puzzle;

at least one surface of each of said fragments comprising at least one of a positioning protrusion and a positioning hollow, wherein a mutually adjacent surface of an adjacent one of said fragments comprises a complementary one of said positioning hollow or protrusion, each said surface having a unique arrangement of said positioning protrusion or hollow, wherein said fragments are adapted to be suitably positioned within the puzzle using corresponding ones of said positioning protrusion and hollow and using said magnetic elements.

2. The puzzle of claim 1, wherein at least one of said positioning protrusion or hollow comprises a readable inscription.

3. The puzzle of claim 2, wherein said inscription comprises symbols from the Braille alphabet.

4. The puzzle of claim 1, wherein the completed puzzle is a reproduction of a work of fine art.

5. The puzzle of claim 1, wherein one of said fragments is a complete reproduction of an object selected from the group consisting of a work of fine art and an animal or human likeness.

6. The puzzle of claim 5, wherein said object is constructed and arranged for positioning in an interior of the puzzle so that an exterior of the puzzle can be completed when said object is absent from the completed puzzle.

7. The puzzle of claim 6, wherein said object is opaque and at least some of a remainder of said fragments are translucent.

8. The puzzle of claim 1, wherein the completed puzzle comprises two parts which are substantially symmetrical with respect to a median plane of the completed puzzle, and wherein one of said fragments comprises the entirety of one of said two parts.

9. The puzzle of claim 1, further comprising a generally planar and continuous support for the puzzle, said support comprising at least one said magnetic element and at least one of said positioning protrusion or hollow, which correspond to ones of said magnetic elements and positioning protrusion or hollow in ones of said fragments which are positioned on said support in the completed puzzle.

10. A three-dimensional puzzle, which upon completion includes plural fragment sites that each has a unique combination of size and shape, the puzzle comprising:

plural primary and plural secondary fragments which each have a unique combination of shape and size so that each of said fragments is arranged and adapted to occupy only a single one of the fragment sites within the completed puzzle, each of said fragments being closely paired with adjacent ones of said fragments along mutually adjacent surfaces in the completed puzzle;

at least two of said fragments each comprising at least one magnetic element oriented so that said at least two fragments are attracted to each other when positioned in their respective fragment sites within the puzzle; and at least one surface of each of said fragments comprising at least one of a positioning protrusion and a positioning hollow, wherein a mutually adjacent surface of an adjacent one of said fragments comprises a complementary one of said positioning hollow or protrusion, each said surface having a unique arrangement of said positioning protrusion or hollow, wherein said primary and secondary fragments are arranged and constructed to form a first three-dimensional object when assembly of said primary and secondary fragments is completed, and wherein said secondary fragments are arranged and constructed to form a second three-dimensional object when assembly of said secondary fragments is completed.

11. The puzzle of claim 10, wherein at least one of said positioning protrusion or hollow comprises symbols from the Braille alphabet.

12. The puzzle of claim 11, wherein the completed puzzle is a reproduction of a work of fine art.

13. The puzzle of claim 11, wherein said secondary fragments are constructed and arranged for positioning in an interior of the puzzle so that an exterior of the puzzle is completed when said primary fragments are completely assembled.

14. The puzzle of claim 13, wherein said secondary fragments are opaque and at least some of said primary fragments are translucent.

* * * * *